US009668569B2

(12) United States Patent
Trasforini

(10) Patent No.: US 9,668,569 B2
(45) Date of Patent: Jun. 6, 2017

(54) METHOD OF MAKING A BRUSH AND BRUSH OBTAINED IN THIS WAY

(71) Applicant: Daniele Trasforini, Calderara di Reno (IT)

(72) Inventor: Daniele Trasforini, Calderara di Reno (IT)

(73) Assignee: Extra Brushes S.R.L., Sala Bolognese (BO) (IT)

( * ) Notice: Subject to any disclaimer, the term of this patent is extended or adjusted under 35 U.S.C. 154(b) by 133 days.

(21) Appl. No.: 14/435,462

(22) PCT Filed: Oct. 17, 2013

(86) PCT No.: PCT/IB2013/059410
§ 371 (c)(1),
(2) Date: Apr. 14, 2015

(87) PCT Pub. No.: WO2014/060976
PCT Pub. Date: Apr. 24, 2014

(65) Prior Publication Data

US 2015/0282604 A1 Oct. 8, 2015

(30) Foreign Application Priority Data

Oct. 19, 2012 (IT) ..... BO2012A0571

(51) Int. Cl.
*A46D 1/00* (2006.01)
*A46B 3/00* (2006.01)
(Continued)

(52) U.S. Cl.
CPC ..... *A46D 1/0207* (2013.01); *A46B 3/005* (2013.01); *A46B 3/04* (2013.01); *A46D 1/04* (2013.01); *A46B 2200/3093* (2013.01)

(58) Field of Classification Search
CPC ..... A46D 1/0207; A46D 1/04; A46B 3/005; A46B 3/04; A46B 2200/3093
See application file for complete search history.

(56) References Cited

FOREIGN PATENT DOCUMENTS

| | | |
|---|---|---|
| DE | 634606 | 8/1936 |
| GB | 605801 | 7/1948 |
| WO | 2010031849 | 3/2010 |

OTHER PUBLICATIONS

International Search Report; Application No. PCT/IB2013/059410; dated Mar. 6, 2014; 5 pages.
(Continued)

*Primary Examiner* — Shay Karls
(74) *Attorney, Agent, or Firm* — John H. Thomas, P.C.

(57) ABSTRACT

Described is an industrial brush (1) comprising a brush body (2) obtained by the solidification of a metal in which the metal wires are locked in a rigid fashion for a first portion (3) thereby having a rigid body.
The second portion of metal wires (4) is, on the other hand, free to perform brushing when the brush body (2) is rotated about a relative axis (5).
The brush body (2) incorporates the metal wires with a structural coupling (with zero tolerance) which keeps unaltered the relative characteristics over time, with heat variations and at high speeds of rotation.
It is also possible to construct the elements of traditional brushes with the same metal and a process is described for constructing new geometrical shapes for producing brushes with synthetic and natural wires with the traditional systems.
Also described is a process for making a brush (1) comprising the steps of feeding in a mold (8) a metal in the molten state (melting temperature less than 2000° C.), in such a way that the first portion of the metal wires (3) is immersed in the metal which, when solidifying, forms a brush body with a rigid structure with a high mechanical strength such as to
(Continued)

render perfectly stable the operation of the brush at high speeds and at high temperatures.

During solidification of the molten metal there is also a heat treatment on the metal wires which improves their mechanical characteristics.

Flanges, outer cups and inner cups with innovative embodiments can also be made with the same molding process, improving the characteristics of the traditional brushes.

15 Claims, 4 Drawing Sheets

(51) Int. Cl.
*A46B 3/04* (2006.01)
*A46D 1/04* (2006.01)

(56) References Cited

OTHER PUBLICATIONS

International Preliminary Report of Patentability; Application No. PCT/IB2013/059410; dated Mar. 9, 2015; 6 pages.
Written Opinion of the International Searching Authority; Application No. PCT/IB2013/059410; 6 pages.

METHOD OF MAKING A BRUSH AND BRUSH OBTAINED IN THIS WAY

TECHNICAL FIELD

This invention relates to a method of making a brush and a brush obtained in this way.

The invention applies to the field of industrial and/or hobby brushes, that is to say, brushes used for machining processes (for example, deburring of surfaces, cleaning of welds, etc.) which can be used both in industrial and private contexts.

BACKGROUND ART

In the process for making brushes according to the prior art, the elements making up the brush are generally assembled using the threaded reduction device.

These components are, for the circular brushes, flanges, ring with wires and reduction device, and for the cup-shaped brushes, inner cup, ring with wires, outer cup and reduction device.

In the prior art methods, firstly the circular part of the reduction device is passed through the central hole present in the parts used for forming the brush, which are all obtained by cold moulding.

Secondly, there is a step for drawing an edge of the extension of the reduction device protruding beyond the elements which form the brush, whilst the other end of the reduction device has a larger dimension to prevent the escape of the elements.

The drawing produces a tab of the reduction device folded to secure together all the elements of the brush body (pressing them against the part of the reduction device with larger dimensions).

There is also, for the cup-shaped brushes, a retaining ring associated with an end portion of the outer cup and positioned outside the first portion of the of the wires for clamping them, exerting a pressure on them towards the inside of the brush, that is, towards the longitudinal axis (which also constitutes the axis of rotation of the brush when this is associated with a spindle).

This retaining ring is currently used, in the cup-shaped brushes, to have a better use of the metal wires.

It should be noted that the industrial brushes also differ according to the semi-worked element used, in which the wires are locked, and the material making the wires which must perform the brushing action.

With regard to the method of anchoring the wires to the flange, the semi-worked elements include twisted bundle rings and crimped or straight wire rings.

In the twisted bundle rings, the wires are grouped together in bundles, and screwed there by twisting; each bundle is associated with a hole formed by the flange close to its outer circumference.

In the crimped wire rings, the flange, which is called the ring nut, forms on a relative outer lateral edge a groove, in which the first portion (that is, the first end) of the wires is inserted.

The ring nut acts in conjunction with a supporting ring, about which the wires are then bent in a "U" shape, to keep the wires in the desired position.

The ring nut is also flanged to keep tight the wires bent and distributed along the entire circumference of the inner supporting ring (made of metal).

With regard to the material making up the wires, the brushes include metal wire brushes, plastic wire brushes, mixed metal-plastic wire brushes and natural wire brushes.

In this regard, it should be noted that the twisted bundle brushes always have metal wires. In other words, the twisted bundles configuration is not used for natural or plastic wire brushes. For this reason, the configuration with crimped or straight wire rings is always used for natural or plastic wire brushes.

The brushes must, for their use, be robust, in such a way as to work at particularly high speeds of rotation without breaking or deforming (in general, the mechanical parts from which they are made break or deform or the wires detach).

Another problem linked to the high speeds of rotation at which the brushes must operate consists in their stability and equilibrium.

The brush must always rotate as a rigid body about its longitudinal axis, which must remain stationary and without any movement from the axis of rotation during the working.

In addition, these must be the characteristics of all the types of brushes, therefore regardless of the materials with which the wires are made or the arrangement of the wires themselves or the system for production of the brushes and the elements used for their assembly (with metal elements obtained by cold moulding or with assembly of the various components with plastic materials).

The prior art deals with these problems by perfecting the finish and the assembly of all the elements which make up the brushes.

However, this results in an increase in the costs of the brushes, due to the number and the complexity of the components and their assembly.

In light of this, another drawback is associated with the fact of having numerous elements which make up the brush so that the brush production firms must hold a large supply of components in store (with a consequent waste of money, resources and space).

A further drawback of the prior art solutions, in terms of robustness and stability of the brush, consists in the machining tolerances of the components, especially of the reduction device and the parts which must be mounted with it for formation of the brush.

Another problem of the prior art solutions is linked to the fact that the brushes, made (for reasons of robustness) with components made of steel, must have increasingly large thicknesses with consequent increases in the costs and the problems in their production by cold moulding.

Lastly, the brushes comprising parts made of iron or plastic cannot be used safely for machining special metal surfaces (for example stainless steel), or in hazardous work environments which require explosion-proof safety measures, as there is the risk of producing sparks or electrostatic charges between the various components of the brush which in turn can produce electrostatic charges in environments with dangerous atmospheres due to the presence of gas.

It should be noted that there are technical solutions which involve welding together the wires of the brush with resins or adhesives, and then coupling a cap (that is, a cup) by pressure to the outside of the ends of the welded wires; the cup being made of plastic material, that is, obtained using special plastic resins or by embedding the wires or the rings with wires (semi-worked elements) in plastic dies.

These plastic caps or cups have a problem linked to the high fragility of the material, so they are only used with plastic wires in order to reduce the mechanical stresses.

This construction method cannot be used for the production of brushes with metal wires due to the high stresses and the high temperatures which are developed during their use.

Moreover, these solutions do not resolve the above-mentioned drawbacks, for example with regard to the possibility of using the brush in sterile environments, or with regard to the robustness and the resistance during operation at high speeds or at high temperatures, because the wires, which are welded and the outer plastic cup only acts as a covering element, detach or break.

Other more recent solutions use systems for the production of brushes with moulding by casting or by injection of the plastic material which, when solidifying, keep together all the components of the brush.

This latter production system, in particular with brushes with metal wires, also has the following main drawbacks:

- there are many unbalanced brushes since the positioning in the mould of the wires or of the rings with wires is problematic;
- the effect of the heating due to the increase in temperatures (approx. 100° C.) during the machining of the brush makes the mechanical strength of the plastic die which assembles the various elements of the brush critical.

This drawback makes the breakage of the metal wires and, therefore, the break up of the brush easier, as the locking due to the plastic die quickly deteriorates with the increase in the temperature:

- plastic cannot be used in the brushes with special metal elements (e.g. stainless steel or non-sparking) as it causes contamination of the surfaces or, as it is a plastic material, it can generate high differences in electrical potential between the various metal parts which make up the brush with the risk of electrical discharges (sparks);
- different materials in the composition (plastic, steel, paints, etc) make the brush a very costly object for recycling.

DISCLOSURE OF THE INVENTION

In this context, the technical purpose which forms the basis of this invention is to propose a method for making a brush and a brush that overcome the above mentioned drawbacks of the prior art.

More specifically, the aim of this invention is to provide a method of making a single brush, with reduction of the production costs and ease of recycling the materials, whilst guaranteeing high levels of robustness even when using with high rotation speeds and at high temperatures (greater than 100° C.).

Moreover, the aim of the invention is to provide a brush or brush element which is simple to make and high in performance.

According to this invention, it is possible to make a brush in which auxiliary elements that can make its use more functional can also be mounted mechanically (e.g. wire retaining ring, ventilation elements or other device).

A further aim of the invention is to provide a brush which can be used safely for machining metal surfaces (for example, made of stainless steel) or in environments which require total explosion-proof safety measures and which can also be easily machined mechanically in cases in which, for example, a greater degree of equilibrium is required.

Moreover, the aim of this invention is to provide a versatile method, by which it is also possible to make elements with innovative geometrical shapes and which are used for traditional brushes and therefore also produce brushes with synthetic or natural wires.

The technical purpose indicated and the aims specified are substantially achieved by a method for method for making a brush and a brush or brush element, comprising the technical features described in one or more of the appended claims.

More specifically, the method according to this invention comprises at least the following steps:

- preparing a plurality of metal wires positioned in such a way as to form at least one bundle having a predetermined width such as to occupy a predetermined space;
- preparing a portion of the metal wires inside a cavity of a mould having a predetermined geometrical shape;
- feeding a molten metal inside the cavity of the mould until the cavity is filled;
- cooling the molten metal to allow the solidification with the portion of metal wires inside, so as to form a single brush body from which the second portion, in use not embedded, of the metal wires protrudes, designed to perform the brushing operation.

It should be noted that the molten metal comprises preferably aluminium or aluminium alloys and that the set of wires is made of metal.

According to the invention, the method comprises a step for tempering the metal wires made by the molten metal fed into the mould on the first portion of the wires and by the mould on the second portion.

Advantageously, the wires are tempered by the embedding in the molten metal, also during its cooling.

Preferably, the tempering of the second portion is achieved by forming in the mould a necking which compresses the wires transversely to their direction of extension, in such a way as to reduce the space occupied.

Thus, the method comprises preferably, between the preparing step and the feeding step, a step for locking the metal wires inside the cavity transversely to a direction of extension of the metal wires by at least one necking having a width less than the predetermined width of the bundle in such a way as to compress the bundle causing a separation of the metal wires into a first portion, embedded in use, and a second portion, in use not embedded. In this way the necking maintains in contact with the wires so as to perform a tempering of the wires.

In the circular brushes, the metal wires extend in a radial direction starting from a central annular body.

In this case, and in particular in the case of brushes with crimped wires, the mould has at least one half-part equipped with an annular protrusion, concentric with the annular body and extending transversely to the wires for compressing them so as to form the necking and delimit the radial extension of the brush body.

Preferably, the mould comprises two half-parts each equipped with a relative annular protrusion opposite the annular protrusion of the other half-part for forming the necking; this also considerably improves the holding of the molten aluminium inside the cavity which forms the brush body.

On the other hand, to make a circular brush with twisted bundles, in which each bundle is angularly spaced from the adjacent one, the mould comprises a central hollow portion, wherein a first portion of the twisted bundles, in use embedded in the brush body, is positioned.

Starting from the central hollow portion, the mould comprises a plurality of radial ducts housing the second portion, in use not embedded, of the twisted bundles, which keep in contact the respective second portion for performing the tempering.

Preferably, also in this case the mould is defined by two superposable half-moulds, each equipped with a central cavity and a plurality of radial grooves extending from the central cavity.

Each groove superposes a corresponding groove of the other half-mould to make the ducts during the casting.

In the cup shaped brushes, the step of locking the the metal wires comprises the following steps:

- positioning a disc-shaped body substantially concentric with an axis of rotation of the brush;
- positioning metal wires on the perimeter of the disc-shaped body;
- positioning an external annular body, in such a way as to define a circular crown for housing the metal wires interposed between the disc-shaped body and the annular body so as to form the necking.

Advantageously, the necking is obtained before inserting the semi-worked element (wires, disc-shaped body and annular body) in the mould.

However, more preferably, in order to guarantee the tempering of the second portion of the wires, the locking step also comprises the following sub-steps:

- preparing a metal bushing made from a different material from the molten metal and from the metal wires and having a diameter less than a diameter occupied by the second portion, in use not embedded, of the metal wires;
- inserting the second portion of the metal wires in the bushing for further reducing the radial extension of the metal wires.

It should be noted that the bushing has an axial extension greater than or equal to the second portion of the metal wires, in use not embedded, in such a way as to remain in contact with it during the feeding step so as to perform a complete tempering of the metal wires.

The bushing is not, however, part of the brush, so the method comprises a step for removing the bushing after the cooling step.

The method allows a repeatability of the construction standard of the brush in a fast and precise fashion with considerable reduction in the costs and with metals such as aluminium which define characteristics of safety and lightness of the brush which cannot be achieved by traditional brushes and with an improvement of the mechanical characteristics of the metal wires.

Again, using the characteristics of metals such as aluminium alloys or similar alloys and using semi-worked elements with wires made of brass, brushes are obtained which are fully explosion-proof and also fully non-magnetic for example using non-magnetic metal elements (e.g. copper etc) for holding the wires made of brass.

Moreover, the locking of the wires performed by the solidification of the metal (aluminium) has a mechanical strength greater than any type of coupling which is currently performed in the sector of brushes.

It is important to note that the coupling between the metal wires and the molten material which forms (once solidified) the brush body occurs immediately; the metal wires heat up (even before the casting) immediately during the step of introduction and contact with the molten metal.

Moreover, this form of contact generates a metallic bond which is perfect and free of impurities between the wire and the metal which, during its solidification, improves this locking by the reduction of the space occupied by the ends of the metal wires.

In addition, the method comprises a step for defining first constraint means on the brush body designed to allow reversible connection with second constraint means complementary to them, defined by an operational support or modular brush.

Preferably, the defining step comprises a step for making a threaded cavity inside the brush body.

Still more preferably, the step for defining the first constraint means is performed at the same time as the step for feeding molten metal into the cavity of the mould. More specifically, the threading is obtained by inserting in the mould a core shaped in a complementary fashion to the threading, in such a way that the metal solidifies with the correct shape.

Preferably, the core is coated with a layer of non-stick material to facilitate the removal.

Preferably, the following steps are comprised between the step for preparing a set of metal wires and the step for feeding molten metal into relative zones defining passage channels for the liquid metal:

- closing a movable part of the mould;
- locking at least the portion of metal wires inside the cavity of the mould. In the preferred embodiment, the locking step is achieved by positioning an annular body (or metal ring) and a disc-shaped body (or cup) concentric with each other in such a way as to form an annular cross-section (or circular crown) for passing through and positioning the metal wires.

Thus, this step is achieved by positioning a disc-shaped body substantially concentric with an axis of rotation of the brush, positioning metal wires perimetrally to the disc-shaped body and positioning an external annular body, in such a way as to define a circular crown for housing the metal wires interposed between the disc-shaped body and the annular body so as to lock the metal wires.

In a further application, the method according to this invention comprises the following steps:

- making a first brush body having a predetermined geometrical shape equipped with at least one substantially cylindrical central portion; the step being performed by feeding a molten metal inside a cavity of a first mould having a predetermined geometrical shape;
- making a second brush body having a predetermined geometrical shape complementary to that of the first brush body; the step being performed by feeding a molten metal inside a cavity of a second mould having a predetermined geometrical shape;
- preparing at least one ring equipped with a plurality of wires protruding radially to it;
- coupling the ring with the first brush body by inserting the ring in the substantially cylindrical portion;
- coupling the second body with the first brush body by pressing; Advantageously, by making the first and the second brush body by casting or injection moulding (preferably using aluminium or an aluminium alloy) it is possible to make brushes (cup-shaped or circular) with non-metallic wires (synthetic or natural) of the most diverse shapes and with reduced production costs.

In effect, the forming by fusing allows fins for reinforcement or cooling of the brush surface to be made, or holes for heat dispersal on the brush body in a simple and economical way.

This invention also relates to a brush or brush element for industrial or hobby purposes, made preferably with the method described above.

The brush preferably comprises a brush body made of metal (corresponding to the solidified molten metal), a plurality of metal wires having a first portion coupled with the brush body and a second free portion, designed to perform brushing when the brush body is rotated about its relative axis, According to the invention, the brush body made of metal is formed from molten metal (with melting temperature less than 2000° C.) and the first portion of the wires is incorporated in and connected to the brush body in such a way as to form a single metal body.

Thus, the industrial brush according to this invention is characterised in that the brush body comprises a binding metal wherein the part of the ring which holds together the metal wires (ring nut and inner ring) or only the ends of the wires is locked. In other words, the metal incorporates the first portion of the wires in such a way as to make the brush body rigid.

More precisely, in the brush according to this invention, unlike prior art brushes, the second portion of wires, in use not embedded, is also made from drawn metal.

By using molten metals, more specifically aluminium alloys with melting temperature of from 700° C. to 800° C., with which the molten metal is fed into the cavity of the mould, and is contained within the range of temperatures for molecular restructuring of the metal wires which are made of carbon steel or stainless steel.

The molecular contact between the various metals (of the brush body and of the wires) improves the mechanical characteristics of the wires (lower fragility, etc which is achieved in the wires during their drawing step or machining for construction of the brush) and in the case of stainless steels with austenitic crystalline structure there is a reduction or even elimination of the residual magnetism (also in this case it is due to the operation for drawing the wires).

Moreover, the brush body constructed in a single block allows a precise alignment of the axis of the brush with the axis of rotation during its operation with consequent balancing of the brush itself (it should be noted that the process is repeatable for all the brushes which are produced).

This operation is perfectly repeatable for the centring elements present in the moulds and in the constructional details with which the crimped wire or twisted bundle rings are assembled.

This balancing of the brush can also be improved (depending on requirements) by removing material from the brush body, where required, by normal mechanical machining and without adversely affecting the compact structure of the brush body.

The metal used for forming the brush body must be such that it can be melted at a temperature of less than 2000° C. so as not create problems for the metal wires and for any metal components that may be comprised in the brush for its forming (ring nut, support ring, etc.).

It should be noted that the use of an aluminium alloy for forming the brush body allows the following advantages to be achieved for the brushes:

- rigid mechanical anchoring of the elements which make up the brush;
- complete recycling of the brush once worn;
- excellent legibility of the use and safety data marked on the brush body;
- improvement of the mechanical characteristics of the metal wires;
- possibility of directly threading the brush body with possibility of reducing the storage and transport costs (it is known that the thread has a diameter greater than those commercially used, which are obtained by coupling the thread with a special adaptor);
- rigid constraint of the metal wires of the brush constant over time, in such a way that the metal wires are not affected by the increase in temperature during the use of the brush or the speed of operation or the breakage of other wires during the operation of the brush;
- excellent chemical resistance of the metal die which does not generate any type of dust during use (and, thus, no pollution of the brushed surfaces);
- with the use of the aluminium alloy, since it is an excellent electrical conductor, there is no difference in electrical potential between the various components (especially using metal wires made of brass).
- possibility of having fully non-magnetic brushes using wires and elements for holding the wires made from non-magnetic materials (such as for example, brass or the like).

Advantageously, in this way the difference in potential between the different parts (elements) of the brush is substantially zero (equal to 0 Volts).

In effect, the casting made of aluminium (or an aluminium alloy) generates a continuous electrical contact between the components of the brush (that is, without gaps) which gives the object a perfect electrical conductivity.

Preferably, the brush also comprises an annular body positioned around a disc-shaped body to form a circular crown to be passed through by the first portion of wires designed to lock them together for positioning inside the mould.

The annular and disc-shaped bodies are also incorporated in the metal in such a way as to form a single brush body made of metal.

Preferably, the metal brush body is equipped with first threaded constraint means. Still more preferably, the first constraint means comprise a threaded hole made directly in the brush body, at its axis of rotation, and a tubular adapter fixed by screwing in the threaded hole to allow the connection between the brush body and a system for its movement.

Alternatively, or in combination, the brush body is equipped with external constraint means designed for being connected to a body of a modular brush.

Moreover, preferably, an outer surface of the brush body defines a plurality of reinforcement protrusions or holes for the load-bearing structure of the brush in the zones most highly stressed during its operation.

To increase the mechanical strength of the brush body, it preferably has a plurality of reinforcement fins and/or through holes for conveying the air to zones where the brushing occurs.

It should be noted that, according to the method described above, the brush body, the metal wires, the annular body (where present) and the disc-shaped body (where present) are made from non-sparking and non-magnetic materials, preferably selected from the following list:

- brass;
- copper or copper alloys;
- aluminium or aluminium alloys.

BRIEF DESCRIPTION OF THE DRAWINGS

Further features and advantages of this invention are more apparent from the non-limiting description which follows of a preferred, non-limiting embodiment of an industrial brush as illustrated in the accompanying drawings, in which.

DETAILED DESCRIPTION OF PREFERRED EMBODIMENTS OF THE INVENTION

Figure 1:
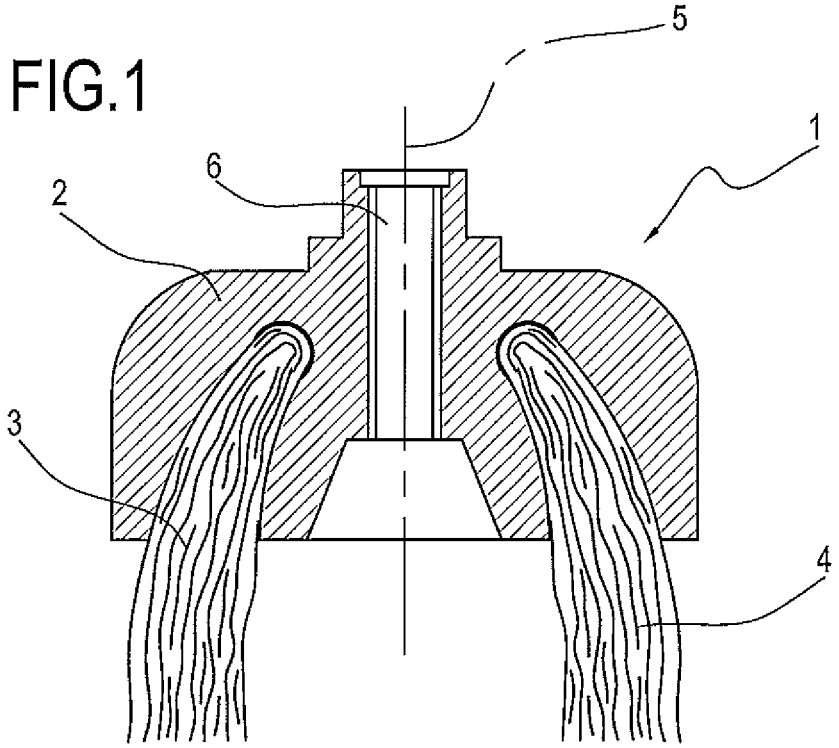
FIG. 1 shows a cross-section of a cup-shaped brush according to this invention with a ring of crimped metal wires embedded in the brush body 2.

With reference to the accompanying drawings, the numeral 1 denotes an industrial brush according to this invention.

The brush 1 comprises a brush body 2 and a plurality of metal wires.

The wires have a first portion 3 embedded in the metal brush body 2 and a second portion 4 designed to perform brushing when the brush 1 (that is, the brush body 2) is rotated about its relative longitudinal axis 5.

Originally, the brush body 2 is formed by a molten metal in which the first portion of the metal wires 3 is fed; the binding metal incorporates the first portion of the wires 3 to make it rigidly integral with the brush body 2.

The above-mentioned brush 1 is made with a method having a step of preparing a plurality of metal wires positioned in such a way as to form at least one bundle having a predetermined width such as to occupy a predetermined space.

The metal wires are positioned inside a cavity of a mould having a predetermined geometrical shape, in which a molten metal is subsequently fed until filling the mould.

Lastly, the molten metal is cooled to allow the solidification with the first portion 3 of metal wires inside, so as to form a single brush body 2 from which the second portion 4, in use not embedded, of the metal wires protrudes, designed to perform the brushing operation.

Thus, the metal brush body 2 originally comprises a rigid block encapsulating the wires or the ring with the wires, obtained by solidifying a molten metal in a mould 8 (for example, by casting or injection moulding).

It should be noted that the method comprises a tempering of the metal wires, made by the molten metal fed into the mould 8 on the first portion 3 of the wires and by the mould 8 (or by auxiliary components) on the second portion 4.

More specifically, the method comprises, between the preparing step and the feeding step, a step for locking the metal wires inside the cavity transversely to a direction of extension of the metal wires by at least one necking 30 having a width less than the predetermined width of the bundle in such a way as to compress the bundle causing a separation of the metal wires into the first portion 3 and into the second portion 4 (that is, delimiting also the brush body 2).

It should be noted that the necking 30 is maintained keeping in contact with the wires so as to perform a tempering of the wires.

Figure 3:
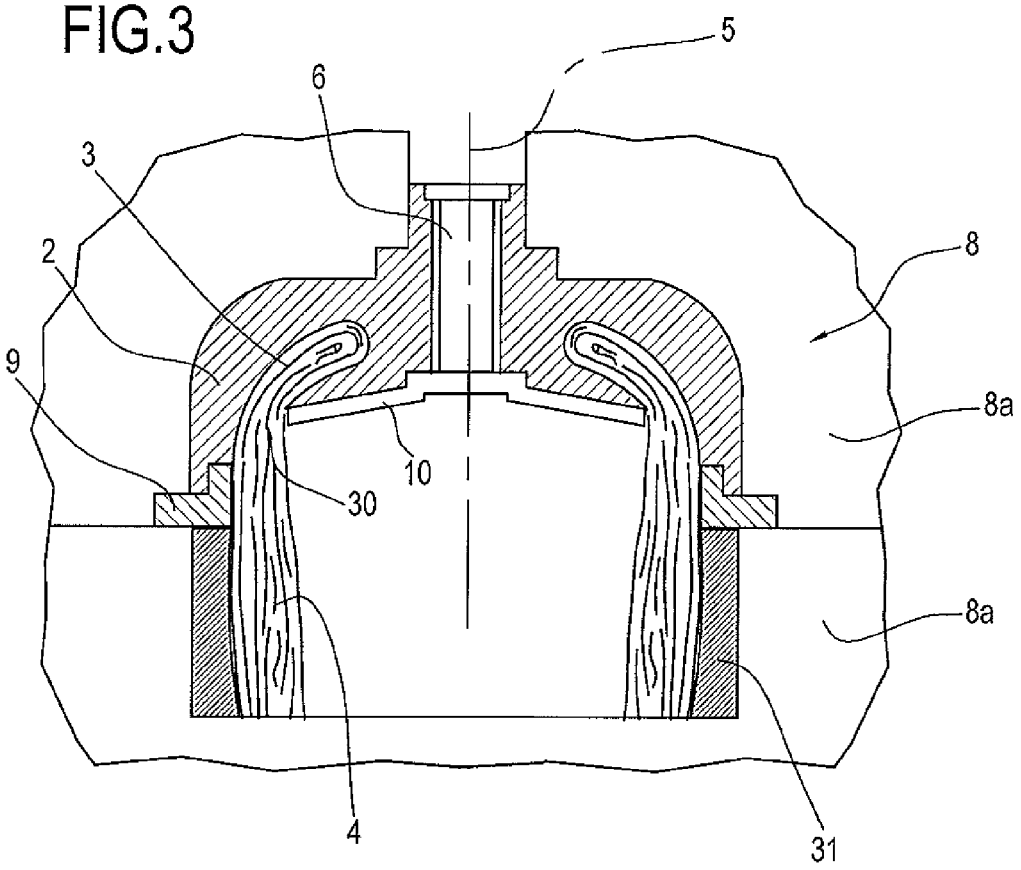
FIG. 3 shows a cross-section of a cup-shaped brush according to this invention with twisted bundles ring and with metal elements to have a precise positioning of the brush inside the cavity of the mould for injection moulding or by casting embedded in the brush body 2.

In the circular brushes (FIG. 3), the metal wires extend in a radial direction starting from a central annular body 16.

In this embodiment, the mould 8 has at least one half-part 8*a* equipped with an annular protrusion 30*a*, concentric with the annular body 16 and extending transversely to the wires for compressing them so as to form the necking 30 and delimit the radial extension of the brush body 2.

Preferably, the mould comprises 8 two half-parts 8*a* each equipped with a relative annular protrusion 30*a* opposite the annular protrusion of the other half-part 8*a* for forming the necking 30.

On the other hand, to make a circular brush with twisted bundles (FIGS. 7 and 8), in which each bundle is angularly spaced from the adjacent one, the mould 8 comprises a central hollow portion 32, wherein a first portion 33*a* of the twisted bundles, in use embedded in the brush body 2, is positioned.

Starting from the central hollow portion 32, the mould comprises a plurality of radial ducts 34 housing the second portion 33*b*, in use not embedded, of the twisted bundles, which keep in contact the respective second portion 33*b* for performing the tempering and the perfect centring of the ring with respect to the axis of rotation.

Preferably, also in this case the mould 8 is defined by two superposable half-moulds 8*a*, each equipped with a central cavity 32*a* and a plurality of radial grooves 34*a* extending from the central cavity 32*a*.

Each groove 34*a* superposes a corresponding groove 34*a* of the other half-mould 8*a* to make the ducts 34 during the casting.

Thus, the twisted bundles brush obtained in this way comprises a brush body 2 formed by a disc 35 equipped along a relative periphery with a plurality of angularly spaced openings 36 in which the wires (that is, the first portion of the bundles) are housed.

In the cup shaped brushes (FIG. 1), on the other hand, the step of locking the the metal wires comprises the following steps:

- positioning a disc-shaped body 10 substantially concentric with an axis of rotation of the brush;
- positioning metal wires on the perimeter of the disc-shaped body 10;
- positioning an external annular body 9, in such a way as to define a circular crown for housing the metal wires interposed between the disc-shaped body 10 and the annular body 9 so as to form the necking 30.

Moreover, preferably, the locking step also comprises a sub-step of preparing a metal bushing 31 made from a different material from the molten metal and from the metal wires and having a diameter less than a diameter occupied by the second portion 4, in use not embedded, of the metal wires.

Also, there is a further sub-step of inserting the second portion 4 of the metal wires in the bushing 31 for further reducing the radial extension of the metal wires (in particular of the second portion 4).

Therefore, the bushing 31 in turn forms a further portion of the necking 30. It should be noted that, after the cooling, there is a step for removing the bushing 31 to complete the making of the brush 1.

With regard to the materials, preferably the binding metal consists in a metal in the liquid phase with a melting temperature of less than 2000° C. and then solidified around the first portion of the wires 3 to incorporate them in the brush body 2.

Preferably, the metal brush body 2 is made of aluminium or an aluminium alloy (melting temperature approximately 800° C.).

Preferably, the brush body 2 made of molten metal forms a recess 6 inside.

The purpose of the recess 6 is to facilitate a connection of the brush 1 to a spindle, that is, to a rotary shaft for rotating the brush during the brushing. However, it should be noted that the presence of the recess 6 is not essential, as the brush 1 could be connected to means for rotating the brush using jaws or other connecting means.

However, the presence of the recess is advantageous as it facilitates the coupling of the brush 1 to the spindle; in addition, there are no tolerances in the centring of the brush when this is fixed to the spindle.

For this reason, in the embodiment shown in FIG. 1 the brush 1 comprises a particularly reduced number of components, that is, it comprises only a ring with metal wires 3 embedded in the brush body 2 formed by the solidified metal.

For this reason, the brush 1 is free of reduction device, as well as flange and cups which are replaced by the solidified metal which considerably improves the mechanical characteristics compared with the current standard.

In light of this, the recess 6 also forms internally a thread to allow screwing of the brush body 2 to the spindle.

Figure 2:
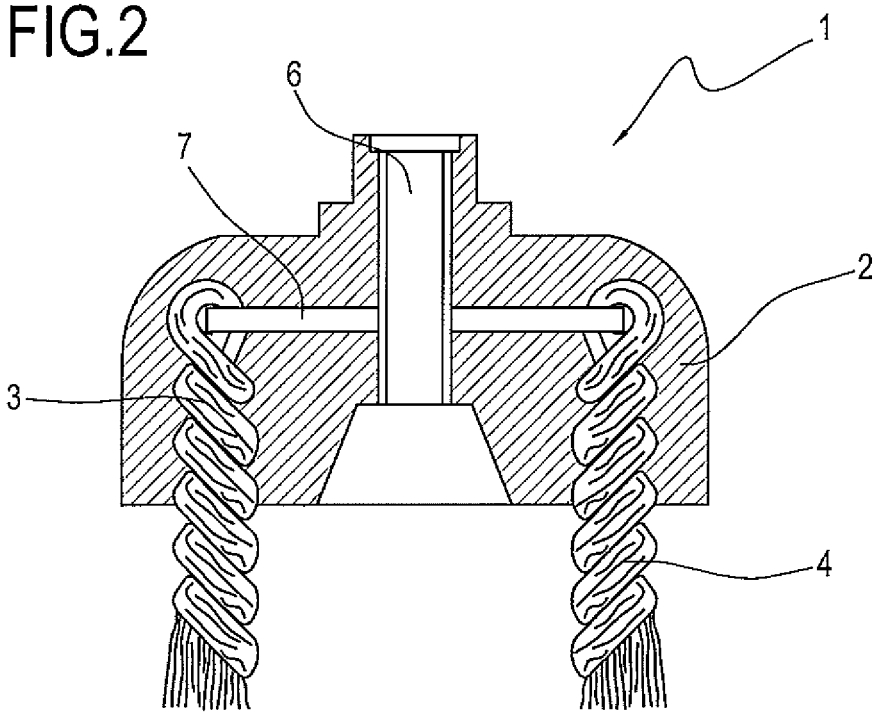
FIG. 2 shows a cross-section of a cup-shaped brush according to this invention with twisted bundles ring embedded in the brush body 2.

FIG. 2 shows a brush 1 equipped with the recess 6 and the flange with twisted bundles 7.

According to another embodiment of this invention (shown in FIG. 3), the brush also comprises a brush body made of molten metal with a geometrical shape suitable for the circular brush with embedded inside a ring with crimped metal wires and with a central hole 6.

Figure 4:
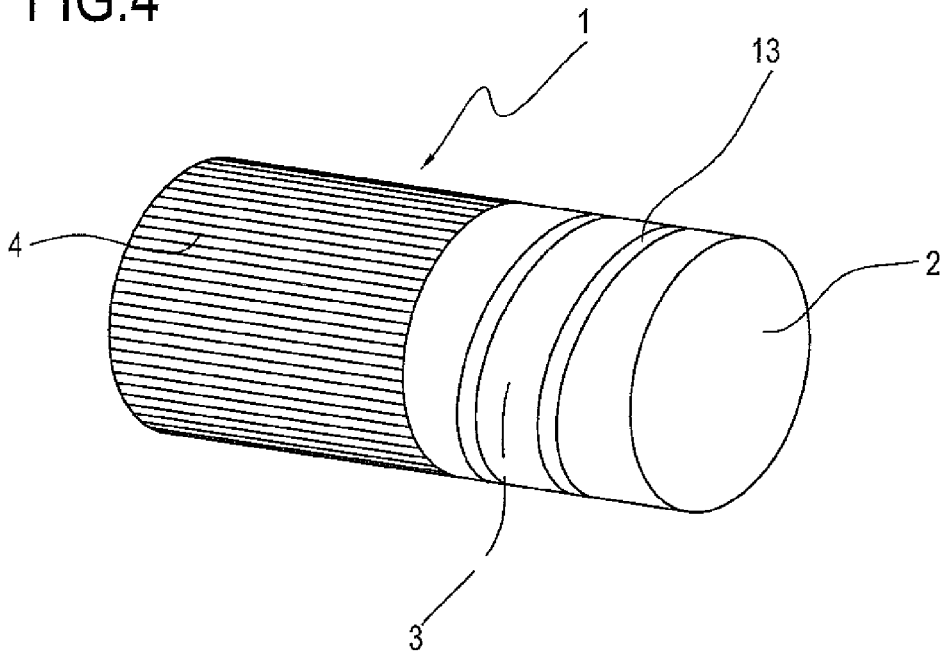
FIG. 4 shows a brush unit for machining processes according to a further embodiment.

According to another embodiment of this invention (shown in FIG. 4), the circular brush is obtained from a ring with twisted bundles embedded in the metal brush body 2 with a central hole 6.

This facilitates, advantageously, the screwing of the circular brush 1 to a spindle; if necessary, the metal die can be threaded directly thereby avoiding the presence of the reduction device.

Figure 5:
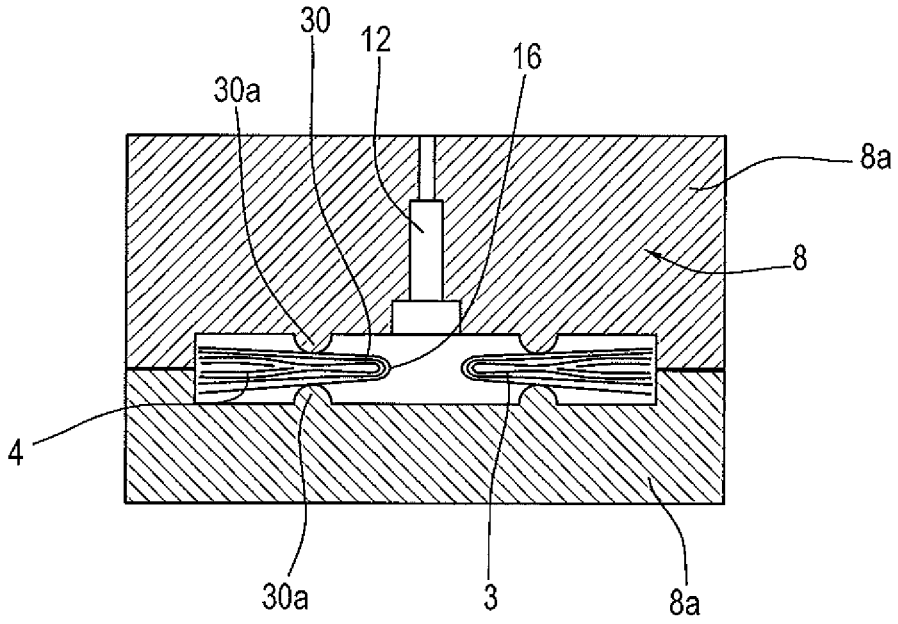
FIG. 5 shows a schematic side view of a step of the production method in question for making a different type of brush, that is, a circular-type brush with shank.

The cup-shaped brush shown in FIG. 5 comprises metallic elements (outer ring 9 and inner cup 10) for the perfect centring of the brush inside the cavity of the mould 8 and an inner flange 10 for holding the metal wires or bundles (as in this case it is not possible to use the ring nut with metal wires for the crimped wire or the drilled holes for the twisted bundles).

The metallic ring 9 with the inner flange 10 are used to have a precise centring of the metal wires with respect to the axis of rotation and to keep them stationary during the moulding step (by casting or injection).

Figure 6:
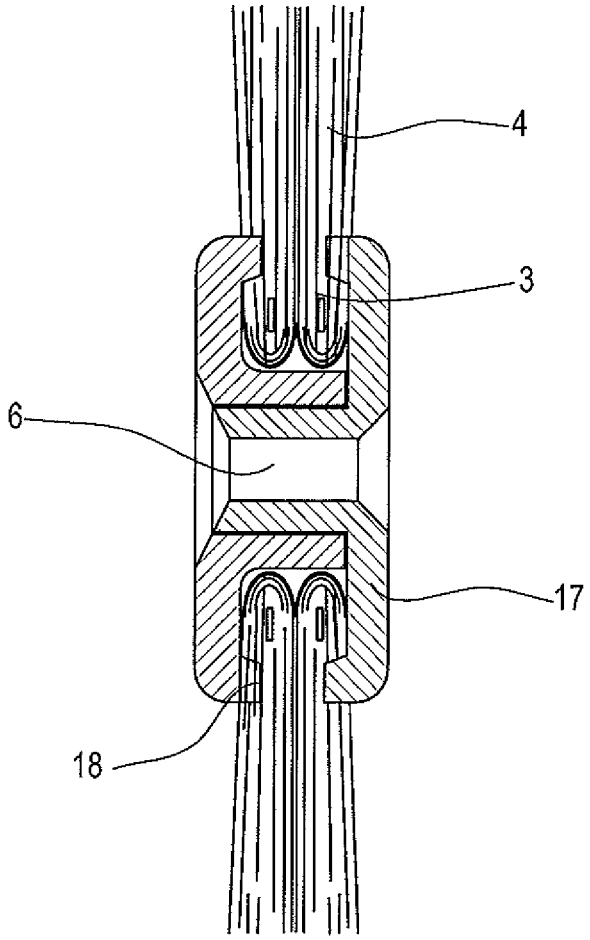
FIG. 6 shows a view of the circular brush produced using aluminium flanges produced by injection moulding or by casting.

In FIG. 6 the brush tool 1 comprises basically a first portion comprising a brush body 2 which will be formed by the free space inside the mould 8 and a first portion of wires 3 positioned inside the mould.

Figure 7:
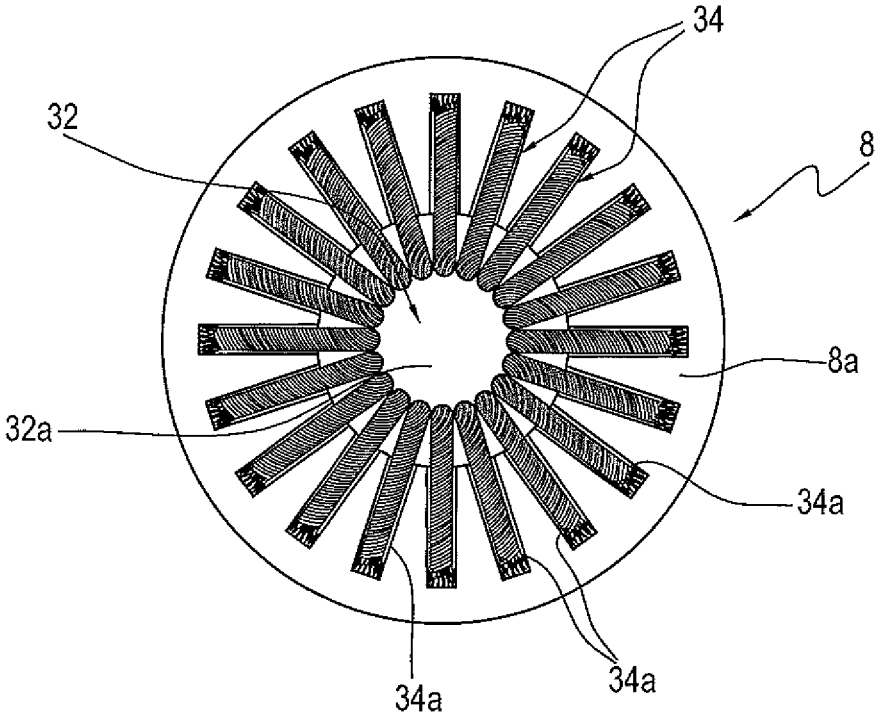
FIGS. 7 and 8 show a mould and a twisted bundles brush made using the mould according to this invention.
Figure 8:
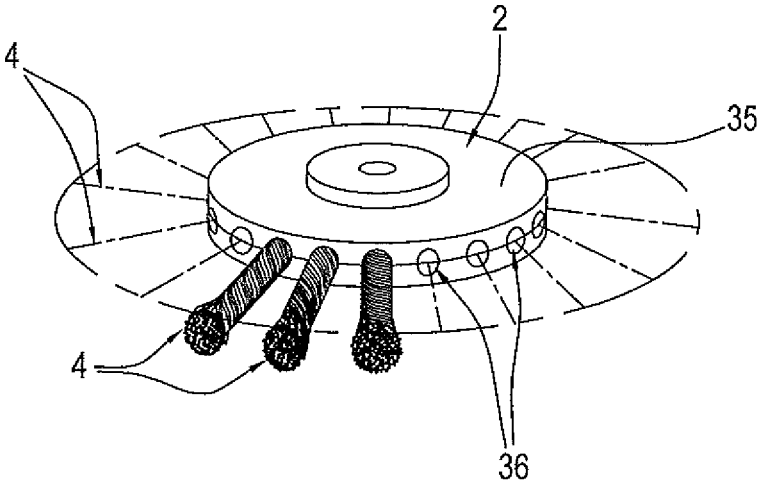

The method comprises the following steps:

preparing a portion of the above-mentioned set of metal wires 3 inside a cavity of the mould 8 having a suitable geometrical shape feeding a metal in a molten form inside the above-mentioned cavity of the mould 8 until filling the cavity through the hole 11.

solidifying the molten metal with a portion of the set of metal wires 3 locked inside to form a brush unit 1 (see FIGS. 7 and 8).

Looking at the method in more detail, the above-mentioned step of preparing the portion of wires 3 can be, for example, a manual positioning introduced in the special cavity of the mould 8.

The cavity of the mould 8 is then closed with a second mobile part 8A of the mould.

The above-mentioned step of feeding the liquid material occurs, preferably, but without restricting the scope of the invention, through the holes 11 of the mould 8.

Purely by way of an example, the above-mentioned feeding step can be achieved by injecting molten metal (preferably aluminium or an aluminium alloy) inside the mould 8, or (see FIG. 6) by casting the molten metal inside the mould 8 with passage of the liquid through the area 11 engaged by the set of wires 3.

Obviously the feeding methods can be of various kinds depending on the shape of the cavity of the mould 8 and on the final shape of the brush body 2.

FIG. 5 shows, by way of an example, a mould 8 for circular brushes 1 with supporting shank 12 to confirm the universal nature of the production method.

FIG. 6 shows a circular brush with synthetic or natural wires with flanges 16 and 17 made of aluminium, produced with moulding by casting or injection, wherein they are pressure fitted relative to each other and with special configurations.

In the figure they are shown for example with a toothing 18 in their inner part (to lock the wires).

In both cases described above, the brush 1 can be obtained in different combinations (with metal or synthetic wires); the liquid material can comprise a metal alloy (aluminium-based) and the set of wires 3 must be made of metal or if the elements are moulded in aluminium the wires 3 can be made from metallic or synthetic or natural material.

In general, the brush 1 for mechanical processes therefore comprises the metal brush body 2 which constitutes the means of joining with the above-mentioned set of metal wires 3 to form a single compact rigid body.

Basically, it may be said that the brush body 2 forms, in a first solution, the actual brush body and also the means of retraining the set of wires 3 to the brush body 2, whilst the free part of the wires 4 is used to perform the brushing.

At a structural level, the above-mentioned first restraining means 6 can comprise a thread made inside the brush body 2.

Alternatively, the brush body 2 can form an intermediate element of association (compaction in a single body) of the above-mentioned set of wires 3 and where the brush body 2 is equipped with the above-mentioned restraining means 13 (see FIGS. 7 and 8).

This intermediate brush element 1 is equipped, on the relative outer surface, of the above-mentioned restraining means 13 matchingly shaped to be associated, in a removable fashion (that is to say, reversibly), with the second restraining means presented by a relative brush body operating inside at least one relative cavity (not illustrated) for removably housing the brush element 1.

As may be seen in FIG. 7, the first removable restraining means 13 comprises a relative thread made, respectively, inside the above-mentioned cavity made on the brush body and on the surface of the brush element 1.

If the threads are made on the brush element 1, the shape of the brush body 2 can be substantially cylindrical.

Alternatively, the brush element 1 can have a substantially frusto-conical shape (see FIG. 8) of the brush body 2 and the application of the brush body can be by interference using the precision characteristics of the brush element 1.

By way of a non-limiting example, a brush is made with the brush element 1 (see FIGS. 7 and 8) and wherein there is a plurality of sets of wires 4 to form the above-mentioned second portion of the wires which perform the brushing.

The second portion of wires 4 is therefore formed by a corresponding plurality of brush elements 1 joined in a single body using the above-mentioned first removable restraining means 13 to a single brush body equipped with a corresponding plurality of cavities equipped with relative second restraining means.

In practice, a modular brush is formed.

The method just described and the brush element obtained achieve the pre-set aims thanks to the simple and fast steps designed to obtain an extremely compact final product, with high technical characteristics and reduced cost.

The homogeneous casting of the molten metal and the set of metal wires with the brush body 2 achieves a modular brush with high mechanical strength with consequent improvement of the operational speeds and the necessary safety thanks to the mechanical locking axis of the various brush elements 1.

Another solution concerns the making of the elements (flanges, cups or the like) with the same process, which can be used in place of those currently used for the brushes.

The method allows a repeatability of the construction standard of the brush in a fast and precise fashion with considerable reductions in the costs and with materials which define characteristics of safety and lightness of the brush element and of the brush which cannot be achieved by traditional brushes.

By exploiting the characteristics of the metals (such as for example aluminium and its alloys) and using brass wires, brushes are obtained which are fully explosion-proof and non-magnetic if elements made with non-magnetic metals are also used for holding the brass wires.

The invention claimed is:

1. A method for making a brush or brush element (1) comprising a first portion of wires (3) embedded in a brush body (2) made of metal and a second portion of free metal wires (4), comprising at least the following steps:

preparing a plurality of metal wires positioned in such a way as to form at least one bundle having a predetermined width such as to occupy a predetermined space; the wires having a first portion (3), in use embedded in the brush body (2), and the second portion of free metal wires (4), in use not embedded;

preparing a portion of the metal wires inside a cavity of a mould having a predetermined geometrical shape;

feeding a molten metal inside the cavity of the mould until the cavity is filled;

cooling the molten metal to allow the solidification with the first portion (3) of metal wires inside, so as to form a single brush body (2) from which the second portion of free metal wires (4) protrudes, designed to perform the brushing operation, and further comprising a step for tempering the metal wires made from carried out by the molten metal fed into the mould (8) in the first portion (3) of the wires and by the mould (8) itself or by auxiliary components in the second portion (4).

2. The method according to claim 1, further comprising, between the preparing step and the feeding step, a step for locking the metal wires inside the cavity, transversely to a direction of extension of the metal wires themselves, by at least one necking (30) having a width less than the predetermined width of the bundle in such a way as to compress the bundle causing a separation of the metal wires into the first portion (3), in use embedded, and into the second portion (4), in use not embedded; the necking (30) keeping being in contact the wires so as to perform a tempering of the wires.

3. The method according to claim 1, wherein metal wires extend with a radial direction starting from a central annular body (16) for forming a circular brush; the mould (8) having at least one half-part (8*a*) equipped with an annular protrusion (30*a*), concentric with the annular body (16) and extending transversely to the wires for compressing them so as to form the necking (30) and delimit the radial extension of the brush body (2).

4. The method according to claim 3, wherein the mould comprises (8) two half-parts (8*a*) each equipped with a relative annular protrusion (30*a*) opposite the annular protrusion of the other half-part (8*a*) for forming the necking (30).

5. The method according to claim 1, wherein the mould (8) comprises a hollow central portion (32) and a plurality of radial ducts (34) extending from the central portion (32); the step of preparing a portion of the metal wires inside a cavity of a mould having a predetermined geometrical shape being performed by locating the first portion (3) of the wires in the central position (32) and the second portion (4) in the ducts.

6. The method according to claim 5, wherein the wires are twisted bundles (33) and the step of preparing a portion of the metal wires inside a cavity of a mould having a predetermined geometrical shape comprises locating each twisted bundle (33) with a radial and angular orientation spaced from the adjacent twisted bundle (33).

7. The method according to claim 5, wherein the mould (8) is defined by two superposable half-moulds (8*a*), each equipped with a central cavity (32*a*) and a plurality of radial grooves (34*a*) extending from the central cavity (32*a*); each groove (34*a*) being superposable with a corresponding groove (34*a*) of the other half-mould (8*a*) for making the duct (34) during the casting.

8. The method according to claim 1, wherein the step of locking the metal wires inside the cavity comprises the following steps:

positioning a disc-shaped body (10) substantially concentric with an axis of rotation of the brush;

positioning metal wires on the perimeter of the disc-shaped body (10);

positioning an external annular body (9), in such a way as to define a circular crown for housing the metal wires (3) interposed between the disc-shaped body (10) and the annular body (9) so as to form the necking (30).

9. The method according to claim 8, wherein the locking step also comprises the following sub-steps:

preparing a metal bushing (31) made from a different material from the molten metal and from the metal wires and having a diameter less than a diameter occupied by the second portion (4), in use not embedded, of the metal wires;

inserting the second portion (4) of the metal wires in the bushing (31) for further reducing the radial extension of the metal wires.

10. The method according to claim 9, wherein the bushing (31) has an axial extension greater than or equal to the second portion (4) of the metal wires in such a way as to remain in contact with it during the feeding step so as to perform a complete tempering of the metal wires.

11. The method according to claim 9, further comprising a step of removing the bushing (31) following the cooling step.

12. The method according to claim 1, further comprising a step for defining first constraint means (6, 13) on the brush body (2) designed to allow reversible connection with second constraint means complementary to them, defined by an operational support or modular brush.

13. The method according to claim 12, wherein the step for defining the first constraint means (6, 13) comprises a step for making a threaded cavity inside the brush body (2).

14. The method according to claim 12, wherein the step for defining the first constraint means (6, 13) is performed at the same time as the step for feeding molten metal into the cavity of the mould (8).

15. The method according to claim 1, wherein the molten metal comprises aluminium or aluminium alloys and that the set of wires (3) is made of metal.

* * * * *